US005590908A

United States Patent [19]

Carr

[11] Patent Number: 5,590,908

[45] Date of Patent: Jan. 7, 1997

[54] SPORTS BOARD HAVING A PRESSURE SENSITIVE PANEL RESPONSIVE TO CONTACT BETWEEN THE SPORTS BOARD AND A SURFACE BEING RIDDEN

[76] Inventor: Donald W. Carr, 836 Knox St., Birmingham, Mich. 48009

[21] Appl. No.: 499,132

[22] Filed: Jul. 7, 1995

[51] Int. Cl.[6] ..... A63C 5/00

[52] U.S. Cl. ..... 280/809; 280/14.2; 280/601

[58] Field of Search ..... 280/14.2, 607, 280/610, 809, 816, 601, 602, 612; 434/60; 200/512; 73/172

[56] References Cited

U.S. PATENT DOCUMENTS

| | | | |
|---|---|---|---|
| 3,644,919 | 2/1972 | Mathauser | 340/573 |
| 3,894,437 | 7/1975 | Hagy et al. | 73/172 |
| 4,288,088 | 9/1981 | Harrison | 280/87.042 |
| 4,516,110 | 5/1985 | Overmyer | 340/323 R |
| 4,545,598 | 10/1985 | Spitaler et al. | 280/612 |
| 4,644,801 | 2/1987 | Kustanovich | 73/172 |
| 4,834,407 | 5/1989 | Salvo | 280/87.042 |
| 4,906,192 | 3/1990 | Smithard et al. | 434/253 |
| 5,010,774 | 4/1991 | Kikuo et al. | 73/172 |
| 5,049,079 | 9/1991 | Furtado et al. | 434/253 |
| 5,079,949 | 1/1992 | Tamori | 73/172 |
| 5,312,258 | 5/1994 | Giorgio | 434/253 |
| 5,332,253 | 7/1994 | Couderc et al. | 280/602 |
| 5,415,633 | 5/1995 | Lazarus et al. | 604/95 |

FOREIGN PATENT DOCUMENTS

| | | | |
|---|---|---|---|
| 0207302 | 1/1987 | European Pat. Off. | 280/809 |
| WO95/20827 | 8/1995 | WIPO . | |

OTHER PUBLICATIONS

Lee O'Connor, "Miniature Motors for Future PCs, Personal Computers; Includes Related Article", Mechanical Engineering–Cime, Feb. 1995, Focus—1 of 3 Stories, vol. 117, No. 2, p. 63 (2–6) ISSN:0025–6501.

"Air Space 1994; Structures, Design and Test", December 1994, p. 70 (8–9), Focus—2 of 3 Stories Aerospace America, Structural Dynamics.

John S. McCright, "ACX Gets Smart With Materials", Boston Business Journal, 37th Story of Level 4, vol. 14; No. 30; Section 1, Sep. 1994, pp. 3–5.

Leslie Helm, Times staff writer, Los Angeles Times "Leaping into the Lead, Americal Ski Maker K2 Ices Europeans", Jan. 3, 1995 (word count 1,476—5 pages).

*Primary Examiner*—Brian L. Johnson
*Assistant Examiner*—Frank Vanaman
*Attorney, Agent, or Firm*—Cushman Darby & Cushman IP Group of Pillsbury Madison & Sutro LLP

[57] ABSTRACT

A sports board (e.g., a snowboard, ski, or surfboard) has a sensor panel comprising a plurality of individual sensors on a surface thereof such that deflection or vibration of surface of the sports board due to contact with a surface of the medium being ridden (e.g. snow or water) causes the individual sensors of the sensor panel to detect such contact. Each sensor on the sensor panel may be a simple switch, piezoelectric sensor, strain gauge, or a variable resistance type sensor. The sensors are monitored so as to detect the points of contact of the lower surface of the sports board with the snow or water. Detailed information related to the contact between the sports board and the snow or water is processed so as to provide auditory, visual or training information.

30 Claims, 5 Drawing Sheets

SPORTS BOARD HAVING A PRESSURE SENSITIVE PANEL RESPONSIVE TO CONTACT BETWEEN THE SPORTS BOARD AND A SURFACE BEING RIDDEN

FIELD OF THE INVENTION

This invention relates generally to sports boards having sensors responsive to a riding surface thereof for sensing contact with a surface on which the sports board rides, e.g., snow or water. More particularly, it relates to a snowboard, alpine ski, nordic ski, water ski, flat surfaced sled, surfboard, wind surfer, or any sports board which is ridden (hereinafter referred to jointly as a "sports board") and which makes contact in varying locations with a surface (i.e. snow, land, water or even possibly air or wind) as the sport is carried out. The invention also relates to any of the above type sports boards altered so as to be operated on dry land.

BACKGROUND OF THE INVENTION

Although the invention is applicable to many sports including skiing, sled riding, and surfing, it is described with reference to snowboarding. Those of ordinary skill in the art will appreciate that the embodiments described are applicable to other types of sports boards.

The experience of snowboarding is one that requires balance, skill and the willingness to take risks. A hybrid of skateboarding and downhill skiing, snowboarding has become the largest growth industry of all winter sports. Though age is by no means a limitation, snowboarding is popular with teenagers who identify with the sport's counter-culture origins. By combining conventional construction techniques with micro-motion sensor technology in a riding surface (e.g., an undersurface), the sports board can detect portions of the board which are in contact with the surface being ridden, e.g., snow.

For instance, in snowboarding, as riders traverse a hill, they constantly shift their weight placing different points of the board in contact with the snow. To convey this contact information to the rider, the snowboard can include circuitry for translating the sensed contact information into either sound emitted from a headset, speaker or ear bud, or into digitized or analog data for use in simulation or reproduction of the ride.

The sound application will be referred to herein as having biofeedback sound. The biofeedback sound informs the rider and brings a new dimension to the experience of snowboarding. The biofeedback sound may also be used to help teach a novice snowboarder. The novice snowboarder can attempt to match tones generated by an expert accompanying the novice or prerecorded expert tones played back as the novice learns to snowboard.

The processed information relating to the contact of the sports board with the surface being ridden may be transmitted to a plurality of receivers using wireless transmission techniques so as to be enjoyed by a plurality of sports board riders. For instance, a plurality of snowboarders each having a sports board according to the present invention and each transmitting processed information may all contribute to an orchestra of sound. Moreover, a prerecorded musical track can be overlaid on the biofeedback sound so as to be perceived as an accompaniment to the musical score.

Prior art devices typically sense a distribution of weight as applied to the sports board through the feet. However, the information provided by such prior art devices is limited in that such devices fail to provide detailed information relating to contact of the riding surface of the sports board to the surface being ridden.

For instance, a rider on a snowboard can lean to one side in order to turn. The conventional device would sense the weight distribution associated with leaning to one side. For instance, a snowboarder may lean in a constant manner so as to traverse a mogul field. The conventional devices would sense a shifted but constant weight distribution to one side. Moreover, when traversing a bumpy field, crevices or holes in the surface, conventional devices would not detect such change in contact with or responsive thereto by the sports board. However, according to the present invention, by sensing the locations of the contact of the snowboard with the snow, detailed information related to traversal of dips, crevices, and moguls on the surface being ridden is provided.

According to the present invention, as the extended ends of the snowboard bend, vibrate and twist with contact to various moguls, or as the snowboard traverses a hole or concave area, the affected sensors on the riding surface or undersurface of the snowboard provide detailed information of various levels regarding the changing contact of the sports board with the surface being ridden, not just information based solely on weight distribution. For instance, the sensitivity and/or number of sensors can be changed to provide a balance between cost and breadth of contact information. For instance, a single sensor having limited sensitivity which senses the contact between the sports board and the medium being ridden would provide more limited information than would a sports board with multiple sensors on multiple layers therein.

The detailed surface contact information as provided by the present invention is useful in producing tones or biofeedback sound related to the combination of sensors activated. Moreover, the surface contact information can be recorded or transmitted to simulation devices for training or entertainment purposes. It is of course possible to combine the present invention with conventional sensors on the upper side of the sports board so as to detect directly a weight distribution in combination with a detailed sensing of the sports board's contact with the surface being ridden.

BACKGROUND OF RELATED ART

Training devices related to the position of a skier are known, as are devices which measure only a weight distribution of a skier.

For instance, U.S. Pat. No. 3,644,919 to Mathauser discloses a signalling device for indicating an improper position of a skier. According to Mathauser, pressure-sensitive switches are mounted on the leg of the skier at a position inside the ski boots. These two switches signal a vibrator to indicate to the skier that he is not in a proper position. This conventional technique provides limited information related only to a perceived improper position of the skier based on the pressure caused by the skiers leg against the inside front surface of the boots. Mathauser's device fails to provide information related to the actual contact of the ski with the snow. Moreover, when the skier is perceived to be skiing in a proper position, Mathauser's device does not provide any information, i.e., it warns against improper skiing only.

U.S. Pat. No. 4,516,110 to Overmyer discloses a ski stress signaling device comprising two strain gauges mounted on the top surface of skis. One strain gauge is mounted in front of the boot while the other is mounted behind the boot. This device senses strain caused on a top surface of a ski. This device appears to be insensitive to lateral stresses of the ski, and does not distinguish between skiing on a flat surface or a surface full of crevices so long as the ski is unstressed or is stressed in a same way. That is, Overmyer's device does not measure a difference in the position of the skis unless stressed from a normal position. A significant strain must be caused in Overmyer's ski so as to cause a strain in the top surface directly in front of or behind the ski boot. Overmyer's device does not provide detailed information relating to contact of a riding surface of a sports board with the surface being ridden.

Furtado et al. disclose in U.S. Pat. No. 5,049,079 a closed loop ski simulation and instructional system which is inoperable for actual skiing. Rather, Furtado et al. relates only to simulation systems. Furtado et al. disclose that skis are bolted to a foot controller including four vertically mounted force transducers positioned at the four corners of the foot controller and positioned under each ski. The foot controller travels back and forth along tracks while the force transducers measure weight distribution applied by the skier. Furtado et al.'s device cannot be used while actually skiing, nor does the device sense actual contact with a surface being ridden. Furtado et al.'s device assumes a flat, constant surface on which the skis are simulated to be riding and discloses no means of accommodating actual skiing.

Giorgio's U.S. Pat. No. 5,312,258 discloses a dry land snowboard training device which is retrofitted to conventional snowboards. The retrofit device includes a layer of ball bearings which enable a snowboard to be ridden on dry land. Giorgio's device does not sense contact with the surface being ridden.

U.S. Pat. No. 5,332,253 to Couderc et al. discloses a binding which modifies the weight distribution of a ski along its sliding surface by adjusting the binding. This device includes a mechanical sensing element raised above the ski and in contact with the sole of the boot. This device does not sense contact of a sports board with a surface being ridden.

Smithard et al. disclose an electronic computerized simulator apparatus in U.S. Pat. No. 4,906,192. According to Smithard et al., a skier is mounted on a rig wearing a pair of skis. The rig includes sensors which measure only the weight distribution of the skier. Smithard et al. is inapplicable to sports boards in actual use. Smithard et al. does not disclose sensing detailed information regarding the contact of the sports board with the surface being ridden.

The prior art does not disclose a sports board which, while in actual use or while in training, senses contact with a surface being ridden to provide detailed information regarding the contact therewith.

SUMMARY OF THE INVENTION

The present invention provides a sports board having a sensor panel on a surface thereof such that deflection of a bottom surface of the sports board due to contact with a surface of the medium being ridden causes individual sensors of the sensor panel to detect such contact. Each sensor of the sensor panel may be a switch providing simple contact/no contact information. Alternatively, each sensor may be a piezoelectric sensor, a strain gauge, or a variable resistance type sensor proving not only the simple contact/no contact information but also an intensity or magnitude of the contact. Of course, a combination of sensor technologies or a multitude of sensor panels are also possible to provide more detailed and more complex information related to the contact of the sports board with the surface being ridden.

It is therefore an object of the invention to provide a sports board having a plurality of sensors on a surface thereof for sensing a plurality of contact points between the riding surface of the sports board and the surface being ridden so as to provide information more detailed than that conventionally obtained by conventional techniques of sensing a weight distribution of the skier.

It is a further object of the invention to process the sensed information relating to the contact of the riding surface of the sports board with the surface being ridden so as to be relayed to the user in auditory, visual or tactile form.

In order to accomplish the above and other objects, the present invention provides a sports board comprising a sports board for traversing a medium to be ridden. The sports board has an upper surface for contact with a rider of the sports board and a riding surface. A sensor panel is formed on a riding surface of the sports board. The sensor panel comprises a plurality of sensors, each of which provides a signal responsive to contact of a respective area of the riding surface of the sports board corresponding to the respective sensor with the medium being ridden.

These and other objects of the present invention will be apparent to those of ordinary skill in the art by the description contained herein.

BRIEF DESCRIPTION OF THE DRAWINGS

The present invention will be better understood by those of ordinary skill in the art with reference to the drawings, in which.

DESCRIPTION OF PREFERRED EMBODIMENTS

As will be illustrated by the embodiments to be described, the invention provides a modification to conventional sports boards (e.g., snowboards, surfboards, etc.) to have a sensor panel included on a riding surface thereof for sensing contact with a surface (e.g., snow or water). Although the present invention is described with reference to embodiments relating to snowboards and a surfboard, the principles of the present invention are equally applicable to other related sports boards (e.g., alpine skis, nordic skis, wind surfer, and flat bottomed sleds). Thus, it is to be appreciated by those of ordinary skill in the art that other conventional sports boards can be modified using conventional construction techniques but so as to include elements as described and as recited by the appended claims.

Figure 1:
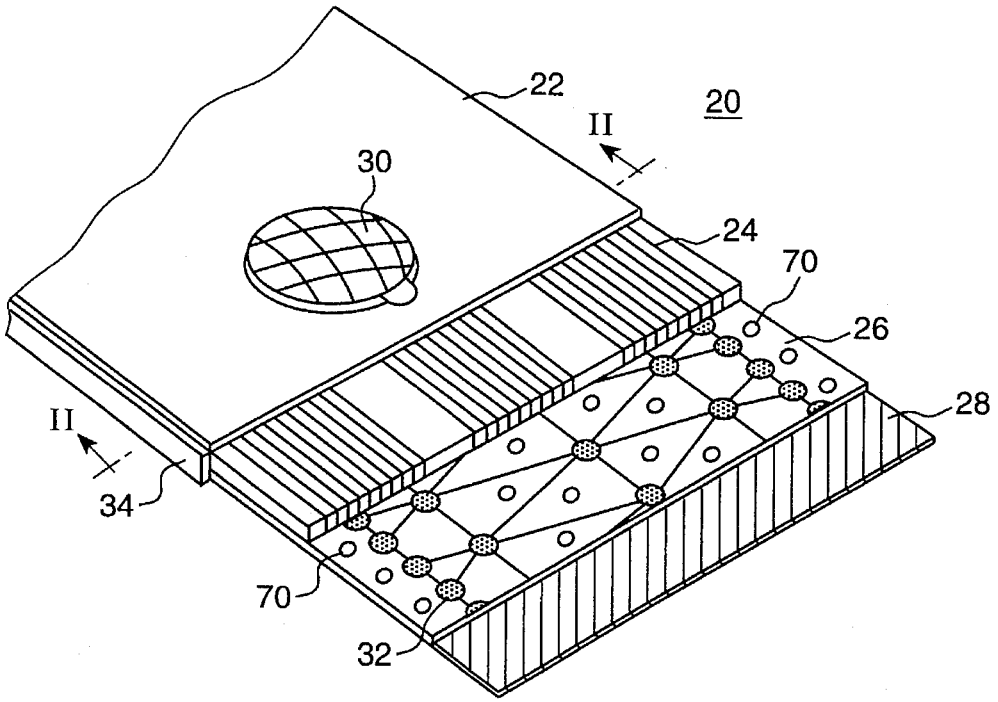
FIG. 1 shows a cutaway view of the layers of a snowboard including a sensor panel on a riding surface of the snowboard according to one embodiment of the present invention.

FIG. 1 shows an embodiment of the present invention in which a snowboard 20 is provided with a sensor panel 26.

The conventional snowboard comprises a deck, a core, and a base. According to the present invention, a sensor panel 26 is inserted between the base 28 and core 24 of an otherwise substantially conventional snowboard.

Figure 2:
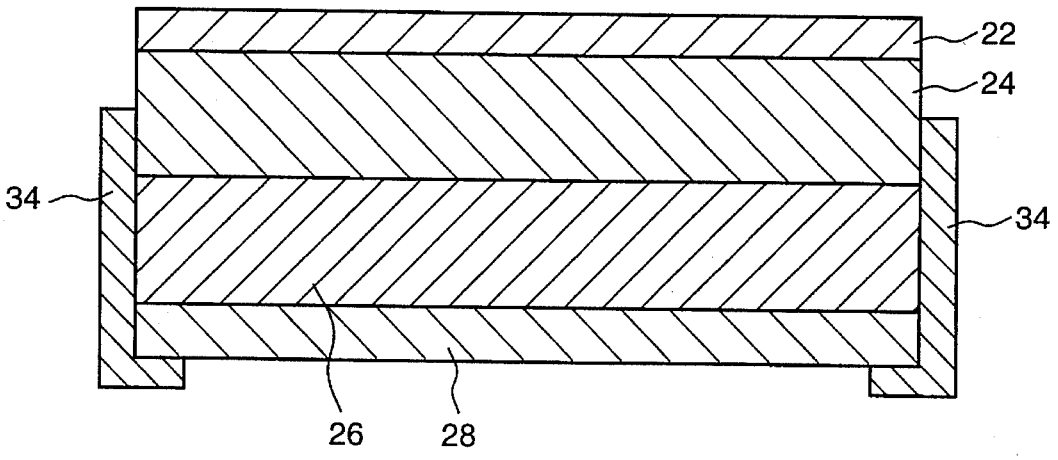
FIG. 2 is a cross-section view of a snowboard along line II—II of FIG. 1 showing the separate layers of a snowboard according to an embodiment of the present invention.

FIG. 2 is a cross-sectional schematical view of the snowboard 20. The deck 22 and core 24 are of conventional construction. The deck 22 of the snowboard 20 is formed of conventional snowboard deck materials, e.g., plastic, wood or P-TEX. Moreover, the deck 22 is assembled to the core 24 in a conventional manner. The core 24 is also made of conventional materials, e.g., wood, plastics, carbon fiber, or HEXCELL metals, and is mounted in a conventional manner to the deck using conventional techniques. The edges 34 of the snowboard 20 are conventional and are mounted into the core 24 and base 28 in the conventional manner using conventional techniques.

The base 28 has a riding surface which contacts directly the surface being ridden. The base 28 protects the sensor panel 26 from external elements. The base 28 is thinned from a conventional thickness so as to allow deflection and thus additional sensitivity to contact made with the surface being ridden.

The base 28 is made of P-TEX or other conventional materials. Other materials may be used instead of conventional materials so long as the base material is sufficiently flexible to deflect when contacted by a desired amount of pressure. Generally, the thickness of the base 28 is adjusted to be thin enough to allow the desired deflection to activate the individual sensors 32 of the sensor panel 26, yet thick enough to have retained sufficient integrity and strength so as to not be ruptured upon ordinary use. The base 28 and the sensor panel 26 may alternatively be formed as one composite construction, then assembled to the core 24 and deck 22 in the conventional manner.

The base 28 is adhered to the core 24 through cut-out sections 70 in the sensor panel 26 (shown in FIG. 1). Alternatively or additionally, the base 28 may be adhered to the sensor panel 26 directly. The base 28 may instead be laminated directly to the sensor panel 26 without the need for the cut-out sections 70 in the sensor panel 26.

The sensor panel 26 may be constructed of a single or multiple layers. If the sensor panel 26 is constructed of a double layer sensor technology, a spacer layer may be inserted between the separate layers of the sensor panel 26. The spacer layer has sections thereof removed corresponding to contact sensing areas.

The sensor panel 26 may be placed on the riding surface of the base 28 if a sufficiently sturdy and resilient sensor panel 26 is used. However, it is preferred that the sensor panel 26 be encased by the base 28 or core 24 so as to provide a protective rugged exterior surface independent of the sensor technology used and so as to protect the relatively delicate construction materials of the sensor panel 26.

In the embodiment disclosed, the sensor panel 26 is mounted between the core 24 and base 28. Preferably, the sensor panel 26 has the same outer dimensions as does the deck 22, core 24 and base 28 so that the manufacturing process of the snowboard 20 is simplified. The sensor panel 26 has a constant thickness throughout so as to be laminated easily between the base 28 and core 24 layers of the snowboard 20.

The sensor panel 26 preferably covers an entire surface between the core 24 and the base 28, although it is possible that the sensor panel 26 covers only specified areas of contact between the core 24 and the base 28. The lamination of the sensor panel 26 is more complicated if it is not of a consistent thickness throughout the entire surface of contact between the core 24 and base 28. Thus, a sensor panel 26 covering the entire surface between the core 24 and the base 28 is preferred. Through holes 70 in the sensor panel 26 serve to facilitate a direct bond between the core 24 and the base 28.

Figure 3A:
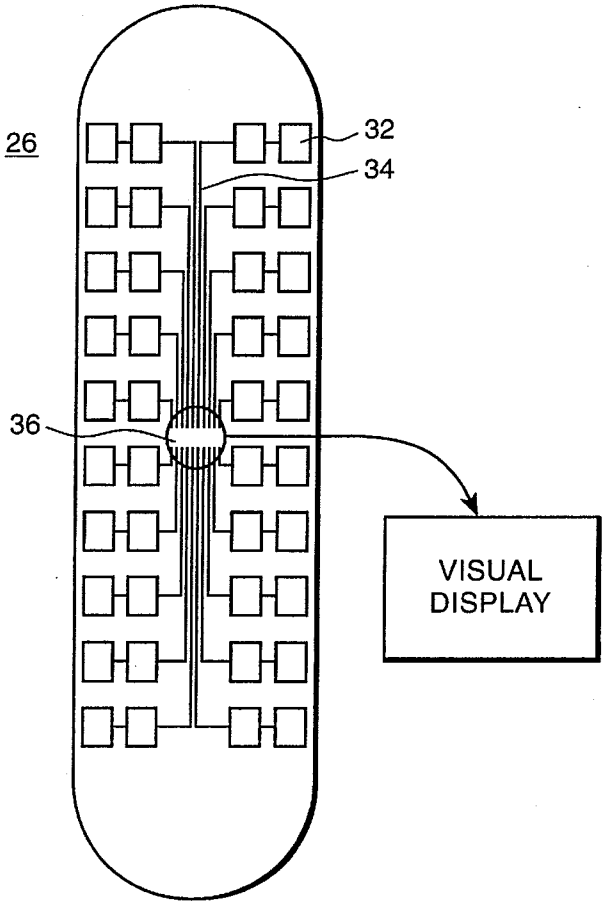
FIG. 3A shows one form of connection between the sensors and a visual display portraying the response of the sports board due to contact with a medium being ridden.
Figure 3:
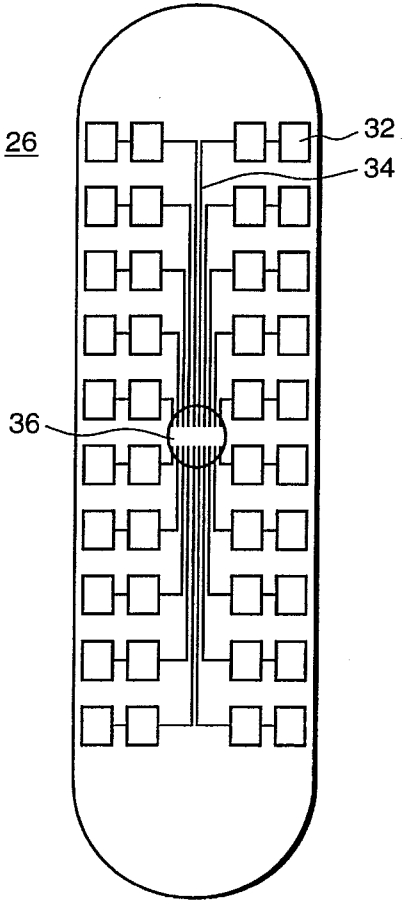
FIG. 3 shows a pattern of sensors of the sensor panel according to an embodiment of the present invention.
Figure 11:
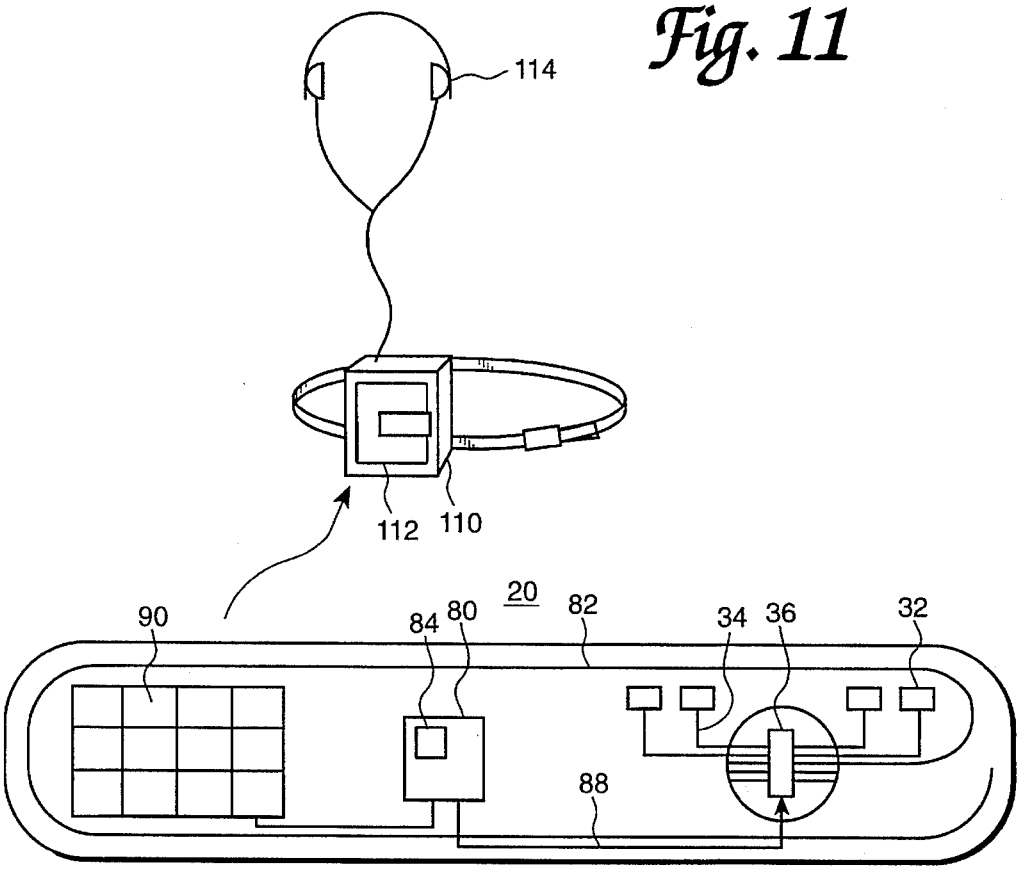
FIG. 11 is a diagram showing portions of a snowboard and a headset for explaining the transmission and reception of sensor data according to an embodiment of the present invention.

The sensor panel 26 comprises a plurality of individual sensors 32 which are each wired to a connector mount 36 in a central area of the snowboard 20 for access by a control module 80, as shown in FIGS. 3 and 11. Although the connector mount 36 is shown in FIG. 3 at the center of the snowboard, it is also possible that the central connector mount 36 be located toward a front or a rear end of the snowboard 20, e.g., as shown in FIG. 11. The individual sensors 32 may correspond substantially to the entire riding surface area of the snowboard 20 or may correspond only to desired areas such as sweet spots of the snowboard 20. Moreover, certain areas of the snowboard 20 may correspond to larger individual sensors 32 while smaller individual sensors 32 may correspond to other areas. For instance, the area immediately under the binding may correspond to two larger sensors 32 on either lateral side of the snowboard 20 whereas the front and rear of the snowboard may correspond to a plurality of smaller sensors arranged laterally across the width of the snowboard 20. The sensors 32 in certain areas may have larger dimensions in a lateral direction than in a lengthwise direction while others of the sensors 32 may have dimensions larger in the lengthwise direction than in the lateral direction.

The individual sensors 32 may be formed using various applicable sensor technologies. For instance, the individual sensors 32 may be formed of piezoelectric, capacitive, contact, resistance or strain gauge type sensors or any combination thereof. The details of each of these sensor technologies is well known in the art and thus the knowledge of those skilled in the art is omitted herein. The aspects of the various types of sensors 32 as they relate to the present invention will be described.

A combination of sensors 32 of differing technologies may be implemented on the same sensor panel 26. Moreover, a plurality of sensor panels 26 may be substituted for the single sensor panel 26 shown in FIGS. 1 and 2 so as to provide a more complex and detailed sensing of the sports board's contact with the surface being ridden. In the case of multiple sensor panels, the information relating to lower sensor panels 26 may be routed through the upper sensor panels 26 using connector strips, e.g., ZIF strips.

Alternatively, an access window (not shown) may be formed in a central region of the upper sensor panel 26 so as to provide access to the lower sensor panel 26 from the deck 22 of the snowboard 20. The sensor panels 26 themselves may be sufficiently flexible so as to allow others of the plurality of sensor panels 26 to sense the contacted surface through the intermediary sensor panels 26. One sensor panel 26 may have only a few large sensors 32 while another sensor layer 26 might have many more smaller sensors 32 to differentiate the contact better. The individual sensors 32 may form a pattern on the sensor panel 26 as shown in FIG. 3, which shows two rows of sensors 32 on either side of a lengthwise center line in sweet spots of the snowboard 20. The sensors 32 may also be placed in a square matrix pattern covering substantially all or a portion of the major riding surface area of the snowboard 20. It is possible that the sensors 32 cover the riding surface of the snowboard 20 entirely. The smaller the sensors 32, the more detailed the information relating to the contact of the snowboard 20 with the surface being ridden. However, the smaller the sensors 32, the more deflection is necessary in the base 28 so as to distinguish between individual sensors 32. Although the sensor panel 26 may comprise anywhere from a single sensor 32 to hundreds or even thousands of sensors, some practical limitations may apply in determining the desired number of sensors 32 on the surface of the snowboard 20 which makes contact with the medium being ridden. For instance, the number of sensors 32 may be determined based on cost, the minimum practical size of the sensor 32 based on the sensor technology, the routing of access wiring 34 between the sensors 32, the placement of an access window or connector mount 36 on the sensor panel 26, and the area of the base 28 required by each sensor 32 in order to attain the amount of deflection necessary to penetrate a spacer layer formed between sensor layers so as to allow activation of the respective sensor 32.

Figure 4:
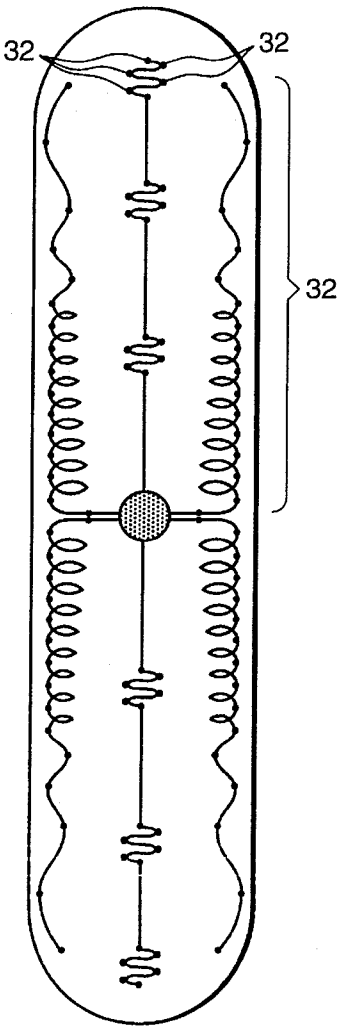
FIG. 4 shows another pattern of sensors of the sensor panel according to an embodiment of the present invention.

FIG. 4 shows a schematic of an alternative pattern of sensors 32 on the sensor panel 26. In this pattern, a higher density of sensors 32 are located in the lateral central area of the snowboard 20 while a sparser density of sensors 32 provides coverage of the front and rear portions of the snowboard 20. The snowboard embodying the sensor panel 26 shown in FIG. 4 may be formed of transparent or translucent materials wherein the individual sensors 32 of the sensor panel 26 are visible. The deck 22, the core 24, and the sensor panel 26 are each formed of clear plastic material and laminated with a transparent epoxy.

In accordance with the desired areas of contact of the riding surface of the snowboard 20, certain areas of the sensor panel 26 may be formed to not include sensors 32 so as to reduce costs associated with the sensors 32. For instance, sensors on the lengthwise center line of the snowboard 20 may be eliminated as this portion of the snowboard 20 is often in contact with the surface on which the snowboard 20 is riding and provides less additional information as do sensors 32 in other areas of the riding surface of the snowboard 20.

The sensor panel 26 of the embodiment is assembled between the core 24 and the base 28 using conventional adhesives and rigs. The sensor panel 26 may instead be integrated within the base 28 or within the core 24 facilitating even further a construction which is conventional. When the sensor panel 26 is integrated into either the core 24 or the base 28, it is preferred that the resulting thickness of the respective core 24 or base 28 does not exceed the conventional thickness. This is so as to facilitate even further the use of conventional jigs and apparatus to assemble the snowboard 20 of the present invention.

In general, the closer the sensor panel 26 is to the contact surface, the more sensitive the sensor panel 26 will be. Thus, to facilitate a better accuracy in the sensing of the contact surface of the snowboard 20, the base 28 is thinned from that of a conventional thickness so as to deflect more against applied pressure from the surface being ridden. Of course, the base 28 must not be thinned so much as to allow damage of the sensor panel 26 or so as to be pierced by ordinary usage.

Figure 5:
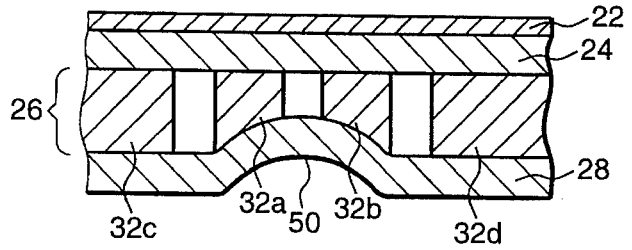
FIG. 5 is a partial schematical cross-sectional view of a sports board with piezoelectric sensors of a sensor panel according to an embodiment of the present invention, certain ones of the piezoelectric sensors being activated by response of the sports board with a surface being ridden.

FIG. 5 is a schematical view showing a portion of a cross section of the snowboard 20 when in contact with a convex surface being ridden. The deflection 50 of the base 28 is exaggerated in FIG. 5 so as to show the aspects of the present invention more clearly.

The individual sensors 32 of the sensor panel 26 are activated by pressure through the base 28 caused by contact of the riding surface of the snowboard 20 with the snow. The sensors 32 are also activated by pressures caused by vibration of the snowboard, for instance, when landing after a jump.

The sensors 32 may be piezoelectric sensors. Piezoelectric sensors 32 may be formed on a single layer of film, e.g., on a MYLAR film. Certain ones of the sensors 32 as shown in FIG. 5 are shown in an activated state by compression due to an area of contact 50 on the riding surface of the snowboard 20. Each sensor 32 produces a signal relating to the contact with the surface. If the sensors 32 are contact type sensors, then sensors 32*a*, 32*b* will indicate a contact condition and sensors 32*c*, 32*d* will indicate a no-contact condition. Thus, information relating to the size of the contact surface can be determined. If the sensors 32 are piezoelectric type sensors or another type of sensors which can indicate a magnitude of the stress or pressure applied thereto, then sensor 32*a* will indicate the largest magnitude of contact, and sensor 32*b* will indicate a substantial amount of contact. Sensors 32*c* and 32*d* will not indicate any contact. If the base 28 is formed of a thicker material having a smaller deflection per unit area, then the effects of a point of contact on the base 28 will be sensed by sensors 32 in a larger area of the riding surface of the snowboard 20. Conversely, if the base 28 is easily deflected, a relatively smaller number of sensors 32 will be affected by the contact. Thus, if contact (ON/OFF) type sensors 32 are to be used rather than sensors capable of measuring a magnitude of the contact, then a more easily deflected base 28 will be desired so as to distinguish between points of contact absent magnitude information. Conversely, if piezoelectric type sensors 32 are implemented, then a less deflective base 28 is necessary because the magnitude information distinguishes various points of contact as limited by the size of the individual sensors 32.

Other conventional strain gauges may also be used as sensors 32. In the cases of piezoelectric sensors 32 or other strain gauge sensors, a voltage is output by each sensor relating to the magnitude of contact and thus the strain caused thereto. The sensors 32 can be wired individually to the connector mount 36 or can be multiplexed through a multiplexer (not shown). For instance, magnitude sensors 32 such as piezoelectric sensors can be individually wired to the connector mount 36 for individual sensing by external circuitry, or contact switch type sensors 32 can be multiplexed into rows and columns as is conventionally known for keyboards and thus providing a more efficient usage of wiring. Single-pole single throw switches (SPST) form the switch type sensors 32.

If the sensor technology used requires a calibration of each individual sensor 32, then the calibration may be accomplished after assembly of the snowboard 20. The calibration factors for each of the sensors 32 may be stored in a memory of a microcontroller contained within circuitry connected to the connector mount 36 of the sensor panel 26. However, it is possible that for low accuracy applications, calibration of each individual sensor 32 is not necessary, thus simplifying the manufacturing process and the necessary circuitry. The piezoelectric sensors 32 of the present embodiment can be formed consistently from sensor to sensor in a same sensor panel 26 and thus conventional thin film technology can be used without individual calibration factors for each of the sensors 32.

Figure 6:
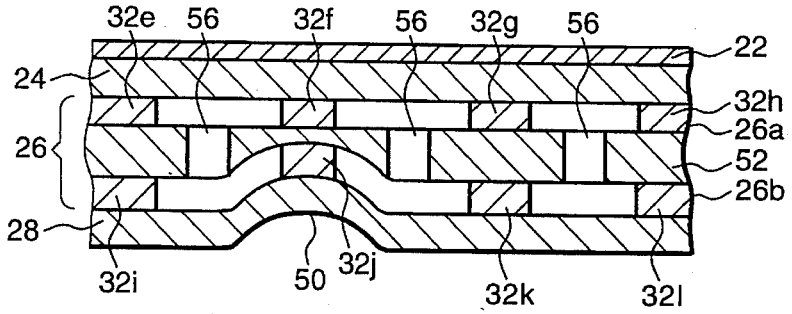
FIG. 6 is a partial schematical cross-sectional view of a sports board with capacitive sensors of a sensor panel according to an embodiment of the present invention, one capacitor sensor being activated by response of the sports board with a surface being ridden.

The individual sensors 32 may be of a capacitive type. FIG. 6 shows one embodiment of capacitive sensors 32 made from two films (e.g., MYLAR films) each having a metallic ink (e.g., silver) silkscreened thereon. First electrodes **32*e*–32*h* of individual sensors 32 are formed in a desired pattern on a first layer 26*a* of the sensor panel 26, e.g., in a pattern as shown in FIG. 3. Second electrodes 32*i*–32*l* of individual sensors 32 are formed in a corresponding pattern on the second layer 26*b* of the sensor panel 26. A dielectric material layer 52 is inserted between the first and second layers 26*a*, 26*b* of the sensor panel 26. Thus, the individual sensors 32 are formed by adjacent pairs of the first and second electrodes 32*e*–32*l*. For instance, electrodes 32*e* and 32*i* correspond to one sensor 32**.

Insulating sections 56 insulate individual portions of the dielectric layer 52. Typically, the individual portions of the dielectric layer 52 are either deposited directly on either layer of the sensor panel 26 or are aligned therewith as a separate layer. The metallic ink and dielectric layer 52 of a capacitive type sensor panel 26 may alternatively be deposited onto a single film. It is also possible to provide a dielectric material layer 52 which has a square matrix of separately insulated dielectric areas having individual areas much less than (e.g., less than 10 times) the area of the smallest sensor. In this way, alignment of the dielectric layer 52 to the individual sensors 32 of the sensor panel 26 is not necessary. By making the individual dielectric areas sufficiently small, no one dielectric area will overlap with an electrode of an adjacent capacitive sensor 32.

As the base of the snowboard contacts a convex portion of the surface being ridden, the base 28 deflects at area 50 shown in FIG. 6. This deflection 50 of the base 28 presses the second layer **26*b* of the sensor panel 26, together with electrode 32*j* of an individual sensor 32, into the dielectric layer 52 and thus reduces an electrical capacity between electrodes 32*f* and 32*j* because of the reduced distance therebetween. The capacitor sensors 32*f*, 32*j*** can thus be charged and measured by electronic circuitry.(not shown) to obtain magnitude information relating to the contact of the sports board with the surface being ridden.

The individual sensors 32 may be of a contact type. Many types of contact switch technology will be apparent to those of ordinary skill in the art. For instance, contact sensors 32 may be formed from two films (e.g., MYLAR film) with silkscreened metallic ink forming corresponding contact switch patterns on each.

Figure 7:
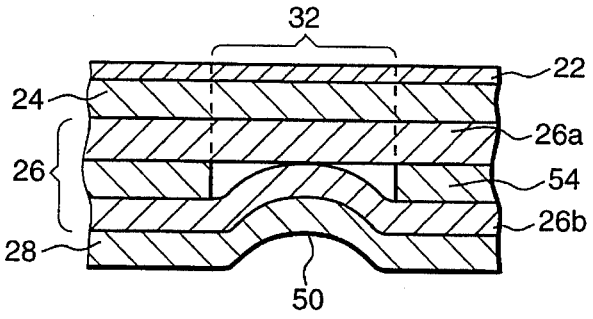
FIG. 7 is a partial schematical cross-sectional view of a sports board with contact switch sensors of a sensor panel according to an embodiment of the present invention, one contact switch sensor being activated by contact of the sports board with a surface being ridden.

FIG. 7 shows a schematical cross-section of a portion of a snowboard with a contact sensor type sensor panel 26. In this embodiment, the sensor panel 26 comprises first and second sensor panel layers **26*a*, 26*b* on opposite sides of a spacer layer 54. The spacer layer 54 is preferably formed of a non-conductive material and prevents the first sensor panel layer 26*a* from contacting the second sensor panel layer 26*b* in areas other than those corresponding to individual sensors 32**.

As shown in FIG. 7, when the base 28 of the snowboard 20 is deflected at area 50, the contacted area 50 of the base 28 is projected upwards into the sensor panel 26. If the contact is of a sufficient magnitude, the second layer of the sensor panel **26*b* is caused to make electrical contact with the first layer 26*a* of the sensor panel 26 in an area corresponding to the contacted area 50. Information relating to the electrical contact of the corresponding sensors 32 is provided to the connector mount 36 for sensing by external circuitry. The second layer 26*b* of the contact type sensor panel 26 may alternatively be formed of a conductive rubber, or of a flexible material containing conductive rubber pads on areas corresponding to each of the sensors 32, so as to provide a more flexible second layer 26*b* of the sensor panel 26**.

Figure 8:
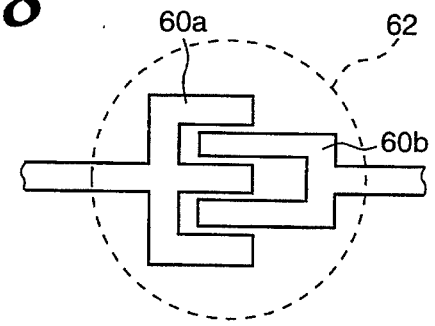
FIG. 8 shows one possible pattern of a contact switch type sensor of a sensor panel and the location of contact of an associated conductive rubber contact pad when caused to come into contact with the switch pattern according to an embodiment of the present invention.

The first layer **26*a* of the contact type sensor panels 26 may have metallic ink or circuitry formed thereon as shown in FIG. 8. FIG. 8 shows a view of one sensor 32 of the first layer 26*a* of the sensor panel 26 as viewed from a riding surface of the snowboard with the base 28 and second layer 26*b* of the sensor panel 26 removed. A conductive pattern 60*a*, 60*b* is formed on the first sensor panel layer 26*a* in an area of each individual sensor 32. The conductive patterns 60*a* and 60*b* are formed so as to not contact each other and to form a switch. The second layer 26*b* of the sensor panel 26 has a conductive pad thereon which is aligned to contact both the first conductive pad 60*a* and the second conductive pad 60*b* substantially in an area indicated by the dotted line 62. As the second layer 26*b* is protruded into contact with the first layer 26*a*, a conductive path is formed between the first conductive pad 60*a* and the second conductive pad 60*b* thus closing the switch and activating the sensor 32**.

Each conductive pad **60*a*, 60*b* is routed individually to the connector mount 36 for sensing by external circuitry. Alternatively and preferably, sensors 32 may be grouped into arbitrarily chosen rows and columns so as to reduce the necessary number of connections between the sensors 32 and the connector mount 36. The number of rows can be made approximately equal to the number of columns so as to provide for the minimum number of external connections. For instance, if the sensor panel 26 is formed with one hundred sensors 32, then a minimum number of external connections to monitor the sensor contacts using sensors 32** grouped in rows and columns is twenty (i.e., 10 rows, 10 columns).

One of ordinary skill in the art will appreciate that other conventional keyboard technologies can be used to create sensor panels and be implemented with a sports board according to the present invention.

Figure 9:
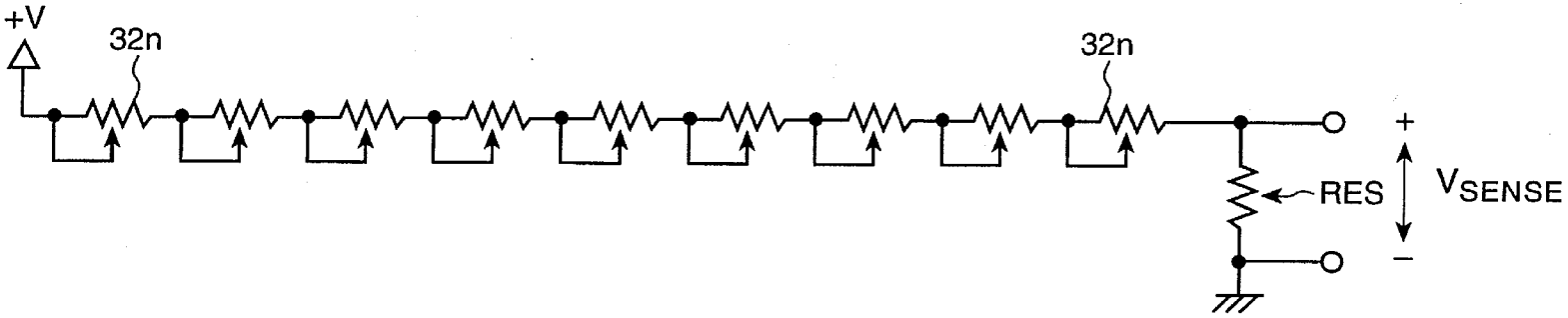
FIG. 9 is a schematic diagram showing electrical connections between resistive sensors of a sensor panel according to an embodiment of the present invention.

Sensors 32 which change resistance as a function of applied pressure thereto may also be used to form the sensor panel 26. Such sensors are referred to herein as resistive sensors. Resistance-type sensors 32 on a sensor panel 26 are shown schematically in FIG. 9, which shows a plurality of resistive sensors 32*n* connected in series with a fixed resistor RES of a known value. As pressure is applied to any of the sensors 32*n* in the series connection, the ratio of the total resistance of the sensors 32*n* as compared with the fixed resistance of resistor RES changes and thus the output voltage Vsense changes accordingly. The external circuitry thus measures Vsense in processing the contact information. Note that if a plurality of sensors 32*n* are connected in series as shown in FIG. 9, the sensing will not distinguish between contact to the first sensor 32*n* in the series or any of the other sensors 32*n* in the series connection. Thus, if very detailed information related to contact to the riding surface of the snowboard is necessary or desired, each sensor 32*n* can be connected in series with respective separate fixed resistors RES and sensed individually by the external circuitry.

The resistive-type sensors 32 of a resistive-type sensor panel 26 typically requires a power supply +V and a fixed resistor for each individually sensed group of sensors.

The sensor panel 26 may be encompassed within any of the layers of the snowboard, i.e., the deck 22, the core 24 or the base 28. Alternatively, the sensor panel 26 may be mounted between any two layers of the snowboard, i.e., between the base 28 and the core 24, or between the core 24 and the deck 22. The sensor panel 26 may be secured with an adhesive or epoxy conventionally used to laminate the layers of the snowboard 20. The sensor panel 26 may be mounted by heat staking or by ultrasonic welds to form plastic-to-plastic type welds between the sensor panel(s) 26, the spacer layer 54 if used, and the applicable layers of the snowboard 20.

The sensor panel 26 is aligned with the base 28 and core 24 using conventional fixturing. The edges of the sensor panel 26 are trimmed even with the edges of the deck 22, core 24 and base 28 as necessary in a conventional manner after the deck 22, core 24, sensor panel 26 and base 28 are assembled together.

The contact information from the sensor panel 26 is processed by a control module 80 shown in FIG. 11. The control module may be a microcontroller or microprocessor with associated random access and read only memory. The control module can either scan each of the sensors 32 sequentially or be interrupt driven upon activation of one or a group of sensors 32.

In the biofeedback sound embodiment of the present invention, activation of each of the various sensors 32 produce a predetermined tone corresponding to that sensor. If a magnitude type sensor 32 is used, e.g. piezoelectric sensors, the volume of the tone produced in response to the activation of a particular sensor 32 may correspond to the magnitude of the contact. Alternatively, the pitch of the tone or other aspects of the tone may vary in accordance with the magnitude of the contact.

As can be appreciated by those of ordinary skill, many types of tones can be produced in accordance with the contact information. The control module 80 may include a personality module or disc 84 which changes the relationship of the tones to the individual sensors or which changes the types of tones produced. Alternate personality modules 84 may be inserted into the control module.

Figure 10:
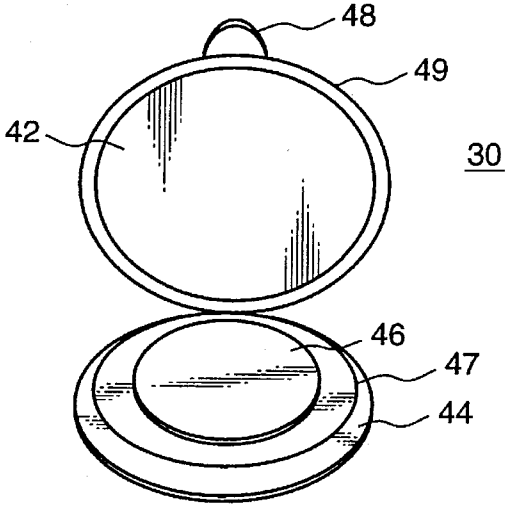
FIG. 10 shows a watertight cover sealing a connector mount access area of the sensor panel according to the present invention.

The control module 80 and or personality module 84 may be mounted under a watertight seal 30. FIG. 10 shows a watertight seal mounted on the deck 22 of the snowboard 20 over a circular bore penetrating through the core 24 and exposing the connector mount 36 of the sensor panel 26. The control module 80 is connected through the connector mount 36 to the individual sensors 32 of the sensor panel 26. Access is gained to the control module so as to change the personality module 84 by opening the rubberized lid 42 of the watertight seal 30 by lifting on pull tab 48. The lid 42 of the watertight seal 30 is closed by pressing down on the rubberized lid 42 so as to cause the rim 49 of the rubberized lid 42 to expand around the mating ring 47. The cylindrical base 44 of the watertight seal 30 is bonded within the surface of the bore in the deck 22 so as to create a watertight seal.

Alternatively, the control module 80 may be mounted remote from the connector mount 36 as shown in FIG. 11. In this embodiment, an electrical or fiber optic cable 88 connects the control module 80 to the connector mount 36 of the sensor panel 26.

The connector mount 36 may be either surface mounted to connection pads formed on the sensor panel 26 or may be PCB mounted in through holes formed in the sensor panel 26. Surface mounted devices provide a slimmer connection but are more prone to failure due to vibrational forces. The PCB mounted connector mount requires a substantial amount of vertical space but provides a strong bond able to withstand vibrational forces often encountered by sports boards in use.

A resin filler or epoxy may be used to fill the surrounding area of the bore in the deck 22 and core 24 wherein the connector mount 36 is allowed to protrude. This provides additional resistance to failure due to vibrational stress.

The contact information may be processed into auditory information (i.e., music). Each of the sensors 32 may correspond to individual chords, tones or notes of any of a multitude of synthesized instruments as are conventionally known. The contact information may be processed into data for use in a visual display, i.e., for simulation of the ride. The simulated ride may be either real time or prerecorded.

Power may be provided for sensor panels 26 requiring power (e.g., resistive type sensors) and for the control module 80 using either conventional batteries or solar power provided by thin film solar panels 90 mounted on an upper surface of the sports board (i.e., on the deck 22 of the snowboard). The thin film solar panels could alternatively be mounted under a transparent layer of material, although the transparent layer of material would likely filter a significant amount of radiation from the solar panels 90. If solar power is used, battery back-up would be desired. Preferably, the back-up battery would be a large capacity capacitor as it will not deteriorate from non-use in the off seasons as would a conventional nickel cadmium battery. Moreover, the capacitor could be sealed permanently within a layer of the sports board so as to provide a better water-tight seal obtained and tested at the factory.

The processed information, i.e. the biofeedback sound, can be heard through a speaker located either on the sports board or remote therefrom.

Figure 12:
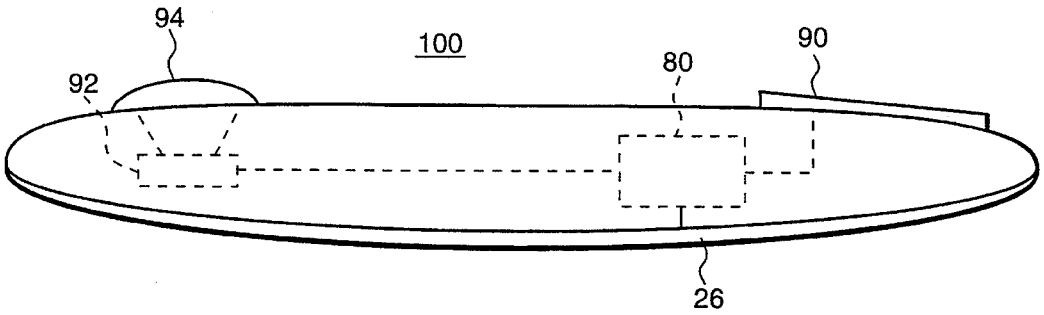
FIG. 12 is schematical cross-sectional side view of a surfboard according to another embodiment of the present invention.
Figure 13:
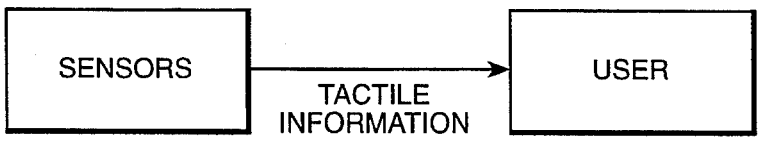
FIG. 13 shows the flow of tactile information from the sensors to the user.

For instance, FIG. 12 shows a surfboard 100 having a sensor panel 26 on a surface thereof. The control module 80 is connected to the sensor panel 26 through wiring internal to the surfboard. The surfboard includes a solar panel 90 for providing electrical power to the control module 80. A speaker 92 provides auditory information related to the contact of the riding surface of the surfboard with the water.

A water-tight seal 94 protects the speaker 92 from the elements.

The speaker may also be remote from the sports board. FIG. 11 shows a snowboard 20 having an antenna 82 for transmission of the contact information. The data is first processed by the control module 80 into tones as desired, then modulated and transmitted through the antenna 82 using conventional AM or FM techniques in a publicly available frequency band. A belt worn receiver module 110 has an antenna 112 for receiving the transmission from the snowboard 20, demodulates the contact information using conventional demodulation techniques, and provides amplification so as to be heard by a headset 114. In this way, multiple receiver modules 110 may listen to a single transmitter. The receiver module 110 may be integrated into the body of the headset 114.

The antenna 82 of the sports board can be mounted within and around any of the layers of the snowboard, including around a perimeter of the sensor panel 26. The antenna can also be mounted as a conventional whip antenna atop the control module 80. A whip antenna for transmission of sensory data from the control module can also be mounted to a binding of a ski or snowboard. The antenna can also be integral to the control module 80 itself.

While the invention has been particularly shown and described with reference to preferred embodiments and alterations thereto, it should be understood by those skilled in the art that various changes in form and detail may be made therein without departing from the spirit and scope of the invention.

I claim:

1. A sporting device responsive to contact with a medium being ridden, said sporting device comprising:

a sports board for traversing a medium to be ridden, said sports board having an upper surface for contact with a rider of said sports board and said sports board having a surface which is ridden on said medium;

a sensor panel on said sports board and formed to be responsive to contact of said sports board with said ridden surface, said sensor panel comprising:

a plurality of sensors, each of said plurality of sensors providing an electrical signal indicating a stressed condition of a respective area of said ridden surface of said sports board corresponding to a respective one of said plurality of sensors as said sports board is traversed on said medium.

2. A sporting device according to claim 1, wherein:

said sports board is one of a snowboard, an alpine ski, a nordic ski, a water ski, a flat surfaced sled, a surfboard, and a wind surfer.

3. A sporting device according to claim 1, further comprising:

a control module to process said electrical signal of each of said plurality of sensors into at least one of digitized data, auditory, visual and tactile information.

4. A sporting device according to claim 3, further comprising:

a solar panel for providing electrical power to said control module.

5. A sporting device according to claim 1, wherein:

said sensor panel is formed within said sports board with said ridden surface of said sports board providing protection to said sensor panel from direct contact with said medium.

6. A sporting device according to claim 1, wherein:

said plurality of sensors are provided on said sensor panel in a higher density along opposite longitudinal peripheral edges of said sensor panel than in a longitudinal center portion of said sensor panel.

7. A sporting device according to claim 1, wherein:

said plurality of sensors include piezoelectric sensors.

8. A sporting device according to claim 1, wherein:

said plurality of sensors include contact switches.

9. A sporting device according to claim 1, wherein:

said plurality of sensors include sensors having a variable resistance.

10. A sporting device comprising:

a base layer, said base layer including a ridden surface which makes contact with an external medium;

a deck layer having an upper layer forming an uppermost surface of said sports board;

a core layer between an inner surface of said base layer and an inner surface of said deck layer; and a sensor panel between said upper surface of said deck layer and said ridden surface of said base layer, said sensor panel comprising:

a plurality of sensors, each of said plurality of sensors providing an electrical signal indicating a stressed condition of a respective area of said ridden surface of said sports board corresponding to a respective one of said plurality of sensors as said sports board is traversed on said external medium.

11. A sporting device according to claim 10, wherein:

a location of said sensor panel is one of between said inner surface of said base layer and a surface of said core layer, encompassed within said base layer, and encompassed within said core layer.

12. A sporting device according to claim 10, wherein:

said plurality of sensors are provided on said sensor panel in a higher density along opposite longitudinal peripheral edges of said sensor panel than in a longitudinal center portion of said sensor panel.

13. A sporting device according to claim 10, wherein:

said plurality of sensors include piezoelectric sensors.

14. A sporting device according to claim 10, wherein:

said plurality of sensors include contact switches.

15. A sporting device according to claim 10, wherein:

said plurality of sensors include sensors having a variable resistance.

16. A sporting device according to claim 10, further comprising:

a control module to process said electrical signal of each of said plurality of sensors into at least one of digitized data, auditory, visual and tactile information.

17. A sporting device according to claim 10, wherein:

said sensor panel is disposed on said deck layer just under said upper layer of said deck layer.

18. A sporting device according to claim 10, further comprising:

a visual display receiving said electrical signal to provide visual information regarding said stressed condition of said sporting device.

19. A method of sensing contact of a sporting device with a medium being ridden, said method comprising steps of:

providing a sports board with a plurality of sensors on a surface thereof, each of said plurality of sensors providing a signal indicating a stressed condition of a respective area of a ridden surface of said sports board corresponding to a respective one of said plurality of sensors as said sports board is traversed on said medium;

continuously monitoring said plurality of sensors; and processing stress information obtained from said plurality of sensors into sensory information.

20. A method of sensing contact of a sporting device with a medium according to claim 19, wherein said step of processing said contact information includes a step of:

mapping said stress information into at least one of digitized data, auditory, visual and tactile information.

21. A method of sensing contact of a sporting device with a medium according to claim 19, wherein:

said stress information is processed into a display signal which illuminates a visual display on said sporting device in correspondence with said stressed condition of said sports board due to said contact with said medium.

22. A method of sensing contact of a sporting device with a medium according to claim 19, wherein:

said stress information is processed through a resistor.

23. A method of sensing contact of a sporting device with a medium according to claim 19, comprising a further step of:

conveying tactile information to a user of said sporting device.

24. A sporting device responsive to contact with a medium being ridden, said sporting device comprising:

a sports board for traversing a medium to be ridden, said sports board having an upper surface for contact with a rider of said sports board and having a ridden surface for contact with said medium to be ridden;

sensor panel means, disposed to sense stress in said sports board due to contact with said ridden surface, for sensing said stress in said sports board due to contact of said ridden surface of said sports board with said medium being ridden, said sensor panel means comprising:

a plurality of sensor means, each of said plurality of sensor means providing an electrical signal indicating a stressed condition of a respective area of said ridden surface of said sports board corresponding to a respective one of said plurality of sensor means as said sports board is traversed on said medium.

25. A sporting device according to claim 24, further comprising:

control module means for processing said electrical signal of each of said plurality of sensor means into at least one of digitized data, auditory, visual and tactile information.

26. A sporting device comprising:

a sports board for traversing a medium to be ridden, said sports board having an upper surface for contact with a rider and said sports board having a surface which is ridden on said medium;

a sensor panel encapsulated within said upper surface of said sports board, said sensor panel being responsive to stress applied to said ridden surface of said sports board, said sensor panel comprising:

a plurality of piezoelectric sensors providing an electrical signal indicating a stressed condition of predetermined areas of said sports board corresponding to said plurality of piezoelectric sensors as said sports board is traversed on said medium.

27. A sporting device according to claim 26, further comprising:

a visual display receiving said electrical signal to provide visual information indicating said stressed condition of said predetermined areas of said sports board.

28. A sporting device according to claim 26, wherein:

said sports board is a ski.

29. A method of sensing contact of a sporting device with a medium being ridden, said method comprising steps of:

providing a sports board with a plurality of piezoelectric sensors encapsulated adjacent a surface thereof, each of said plurality of piezoelectric sensors providing an electrical signal indicating a stressed condition of said sports board corresponding to a respective one of said plurality of piezoelectric sensors as said sports board is traversed on said medium; and continuously monitoring said plurality of piezoelectric sensors to detect said stressed condition.

30. A method of sensing contact of a sporting device with said medium being ridden according to claim 29, wherein said method comprises a further step of:

illuminating a visual display on said sports board in response to a predetermined level of said stressed condition of said sports board.

* * * * *